United States Patent [19]

Murther

[11] Patent Number: 4,531,485

[45] Date of Patent: Jul. 30, 1985

[54] OVER RIDE OIL PUMP

[76] Inventor: Howard D. Murther, 415 E. 71st St., New York, N.Y. 10021

[21] Appl. No.: 585,276

[22] Filed: Mar. 1, 1984

[51] Int. Cl.[3] ..... F01M 1/00

[52] U.S. Cl. ..... 123/196 S; 123/196 R; 123/198 C

[58] Field of Search ..... 123/196 R, 196 S, 198 D, 123/198 C

[56] References Cited

U.S. PATENT DOCUMENTS

| | | | |
|---|---|---|---|
| 2,102,514 | 12/1937 | Clarkson | 123/196 S |
| 2,178,756 | 11/1939 | Joost | 123/196 S |
| 2,838,039 | 6/1958 | Smith et al. | 123/196 S |
| 2,889,821 | 6/1959 | Maki | 123/196 S |
| 3,841,291 | 10/1974 | Ludewig | 123/196 S |

*Primary Examiner*—E. Rollins Cross

*Attorney, Agent, or Firm*—Richard L. Miller

[57] ABSTRACT

An over ride oil pump for use with reciprocating or rotary engines which provides auxiliary oil pumping under three circumstances by use of an electrically operated oil pump, digital circuitry and sensors. As a car is started the standard mechanical oil pump cannot provide adequate lubrication since the mechanical pump can only pump at a rate proportional to engine speed. The over ride pump begins immediately, upon initiation of engine start up. Under conditions of high RPM operation extra lubrication is required. The over ride oil pump senses increased vacuum levels and provides additional oil delivery. Oil pressure drops rapidly if there is a failure in the mechanical pump drive mechanism or the pump itself. The over ride oil pump senses this deficiency and provided the necessary oil delivery.

7 Claims, 2 Drawing Figures

OVER RIDE OIL PUMP

BACKGROUND OF THE INVENTION

The present invention relates generally to systems for lubricating reciprocating or rotating engines. In a typical situation, before an engine is started, oil has accumulated in the oil pan due to gravity feed. When ignition is initiated and the starting motor begins to turn over the engine, in many engines a mechanical pump which is often powered by the engine via a belt or gears, begins to pump oil through the engine block. At the time when lubrication is most critical, i.e. at the instant of ignition, this mechanical pump is least capable of supplying oil under pressure. This is compounded by the oil possibly being quite viscous to due to low temperature storage in the oil pan.

Specifically during rapid acceleration of a motor vehicle powered by such an engine; when the engine is turning over at a high rate of speed the mechanical oil pump experiences difficulty in maintaining sufficient oil pressure. However, this is a transient phenomenon, since once the vehicle has reached cruising speed engine RPMs decrease. During periods of great acceleration and engine speed the vacuum pressure in the intake manifold and the carburetor increase significantly.

Since many oil filter pumps are mechanically driven, the oil pump driving mechanism sometimes fails resulting in a sudden, dangerous fall in oil pressure. The vehicle should not be driven to prevent damage to parts of the engine, which, for all practical purposes have lost all lubrication, and in most cases a considerable degree of cooling capacity.

SUMMARY OF THE PRESENT INVENTION

It is therefore a primary object of the present invention to provide an over ride oil pump which acts supplementary to the normally supplied mechanical oil pump under a number of circumstances.

Another object is to provide an over ride oil pump which begins to pump oil as soon as the ignition switch is turned to the "on" position and continues to operate until the oil pressure has climbed to the normal level. This is accomplished in the present invention by sensing the presence of the ignition switch being rotated to the "ON" position while at the same time oil pressure is being monitored. An "ON" ignition switch condition together with a low oil pressure indication results in the activation of the over ride oil pump.

Another object is to provide an over ride oil pump which pumps oil when the engine RPM exceeds a certain pre-determined level. This is accomplished in the present invention by sensing the presence of a high vacuum level in the intake manifold or carburetor at the same time that rotation of the ignition switch to the "ON" position is sensed. An "ON" indication together with high vacuum pressure results in the activation of the over ride pump.

A yet further object is to provide an over ride oil pump which pumps oil when the mechanical oil pump fails to deliver sufficient oil pressure due to the failure of the mechanical oil pump drive mechanism or due to some defect in the mechanical oil pump itself. This is accomplished in the present invention by sensing the presence of a low oil pressure level at the same time that rotation of the ignition switch to the "ON" position is sensed. An "ON" indication together with low oil pressure results in the activation of the over ride oil pump.

A still further object is to provide an over ride oil pump which is activated for a fixed interval of time each time ignition is initiated. This is an alternative to turning off the over ride oil pump when sufficient oil pressure has been reached allowing extended overlap in operation between the two pumps. This is accomplished in the present invention by initiating a timer each time the starting motor is activated. This timing signal, in the presence of an "ON" signal from the ignition switch keeps the over ride oil pump pumping for a predetermined interval.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENT

Figure 1:
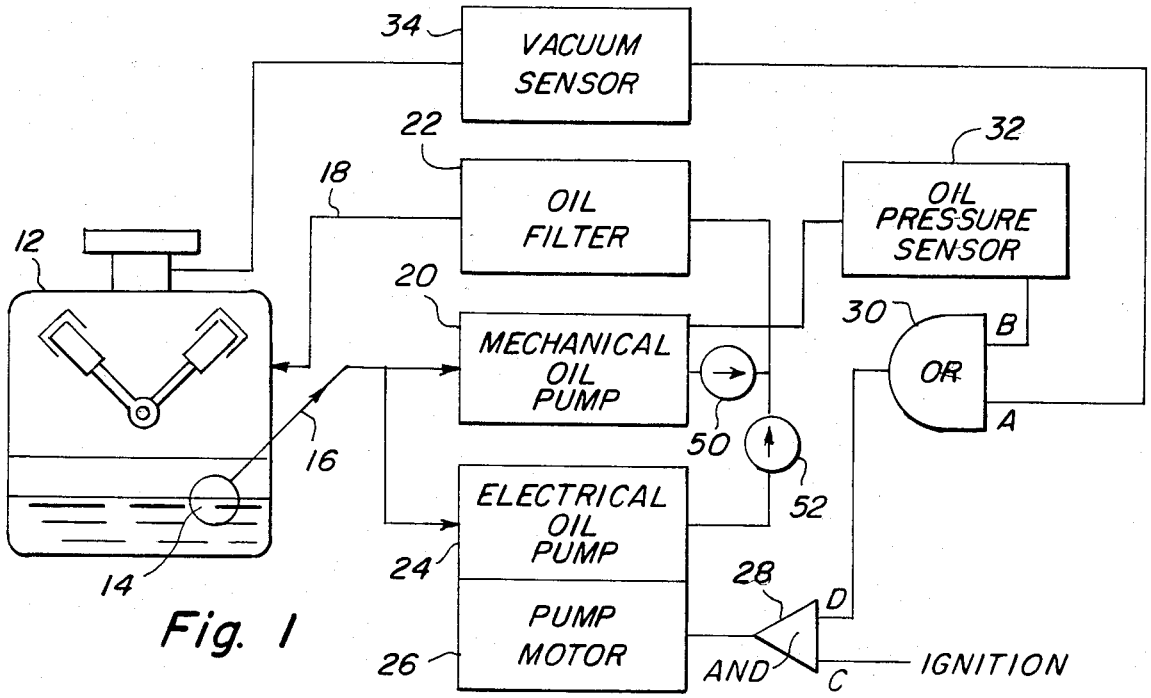
FIG. 1 is a block diagram of the invention for typical use with a gasoline engine showing vacuum sensing.

In FIG. 1 a typical gasoline engine 12 is shown. Oil is pumped out of engine 12 via oil sump 14 through oil outlet pipe 16 and filtered oil, under pressure is returned through oil inlet pipe 18. In normal operation of the engine at mid-range speeds, oil from outlet pipe 16 is pumped through mechanical oil pump 20, through oil filter 22 and back to the engine via oil inlet pipe 18. In the present invention, an electrical mechanical oil pump 24 along with its pump motor 26 is connected in parallel with mechanical oil pump 20 and operates under three separate circumstances.

The first circumstance requires oil to flow under pressure immediately upon rotation of the ignition switch to the "On" position permitting oil flow as soon as possible. When the ignition switch is placed in the "ON" position a positive voltage or binary "1" appears at input C of "AND" gate 28. Since the oil pressure at this time is zero, a low oil pressure sensor 32 appears as a binary "1" at input B of "OR" gate 30 producing a binary "1" at output of "OR" gate 30 and therefore a binary "1" at input D of "AND" gate 28. Since both inputs of "AND" gate 28 are binary "1"s the output of "AND" gate 28 is also a binary "1" and the pump motor 26, part of electrical oil pump 24 operates. As soon as the oil pressure reaches an adequate level the oil pressure sensor 32 outputs a binary "0" to "OR" gate 30. The vacuum sensor 34 is seeing a reasonably small vacuum so its output is also a binary "0". With input A at "0" and input B at "0" the output of "OR" gate 30 is also a "0". Therefore, the input C of "AND" gate 28 is "1" while input D is "0" and the output of "AND" gate 28 is "0". The electrical oil pump 26 stops.

The second circumstance requires oil to flow under pressure when the engine is demanding rapid delivery of oil at high RPMs. Under this circumstance, when the ignition switch is placed in the "ON" position a binary "1" appears at input C of "AND" gate 28. Under conditions of high engine RPM, vacuum sensor 34 sees an especially high vacuum and outputs a binary "1" to input A of "OR" gate 30. Oil pressure sensor 32 is still seeing a relatively normal pressure and so outputs a "0" to input B of "OR" gate 30. The net result if these inputs areto produce a "1" at the output of "OR" gate 30 and therefore a "1" at the input D of "AND" gate 28. "AND" gate 28 seeing a "1" at both inputs produces an output of "1" and pump motor 26 of electrical oil pump 24 operates. It may be easily seen that when vacuum returns to normal with normal RPMs pump motor 26 ceases to operate.

The third circumstance under which auxiliary pumping is necessary occurs when oil pressure drops due to either a failure in the mechanical pump's drive mechanism, or a mechanical failure of the mechanical pump itself. In either of these situations, oil pressure sensor 32 senses a drop in pressure below some predetermined level and sends a "0" to input A of "OR" gate 30. This input configuration results in a "1" at the output of "OR" gate 30 and a "1" at input D of "AND" gate 28. Since the ignition switch is in the "ON" position a "1" appears at input C of "AND" gate 28. This input configuration produces a "1" at the output of "AND" gate 28 and pump motor 26 of electrical oil pump 24 operates. It may be easily seen that as soon as oil pressure of the mechanical pump returns to normal, electrical oil pump 24 ceases to operate.

Figure 2:
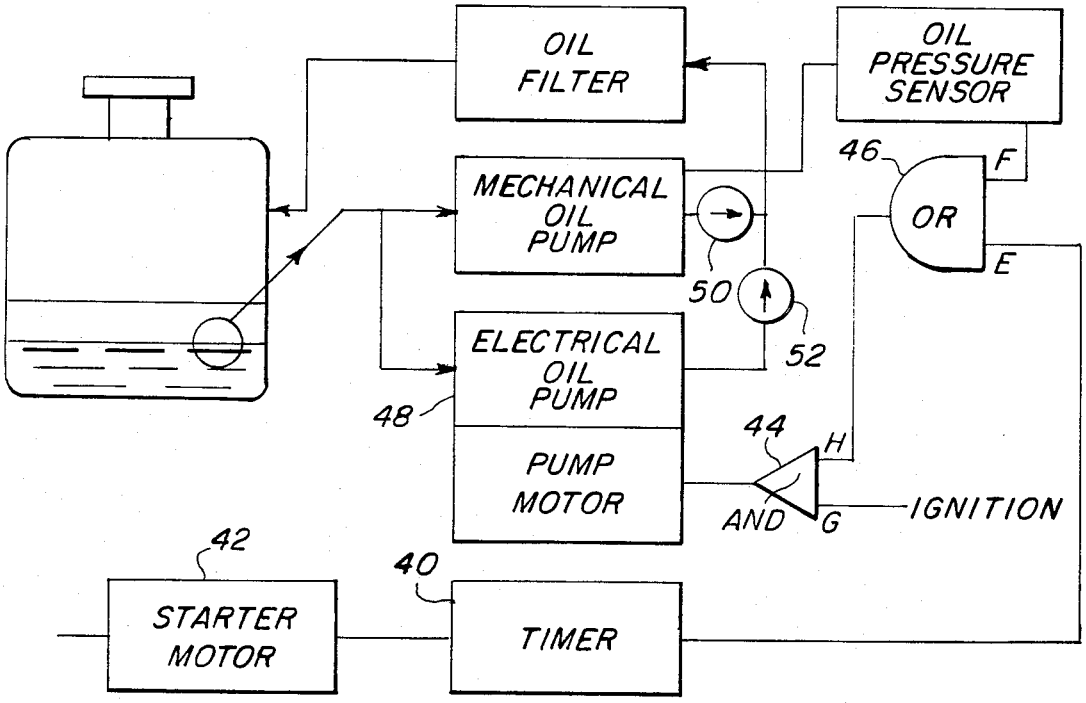
FIG. 2 is a block diagram of the invention for typical use with a diesel engine shown without vacuum sensing but with pre-timing of initiating override pump activating signal.

FIG. 2 shows an alternative embodiment in which vacuum sensing has been eliminated. In some types of engines, particularly diesels, meaningful vacuum sensing is very difficult. Another system of causing oil to flow immediately upon rotation of the ignition switch to the "START" position is demonstrated in FIG. 2 and depends upon a preset timer to cease electric pumping instead of the attainment of a predetermined level of oil pressure. The system is essentially identical with that in FIG. 1 except that a timer 40 has been added which sends out a binary "1" from the time starter motor 42 initiates the timer until some pre-set interval has expired. When the ignition switch is placed into the start position a binary "1" appears at input G of "AND" gate 44. The ignition switch, since it is in the "START" position, activates starting motor 42 which initiates timer 40 producing a binary "1" at the input E of "OR" gate 46. This produces a "1" at the output of "OR" gate 46 and a "1" at input H of "AND" gate 44 for the duration of the pre-set timing interval. This input configuration produces a "1" at the output of "AND" gate 44 and the electrical oil pump 48 therefore also operates for this interval.

Depending upon pump design it may be necessary to install one-way check valves at 50 or 52 in FIGS. 1 or 2 to prevent oil from being pumped from the output of one pump back through the other pump.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An over ride oil pump comprising in combination a mechanical oil pump which normally delivers oil to an engine which is running; an electrical pump with associated pump motor which pumps oil to said engine at the time of ignition before said engine has come up to speed, during periods of exceptionally high engine speed, and when said mechanical oil pump has failed to deliver sufficient oil pressure; supply means for supplying oil from the engine oil sump to both said mechanical oil pump and said electrical oil pump, in parallel; a filter receiving pumped oil from both said mechanical oil pump and said electrical pump, in parallel, for removing undesired debris from said oil; means for receiving a multiple of signals and combing them for activating said electrical oil pump with associated pump motor, said signals including an ignition signal, an oil pressure signal, and a vacuum pressure signal; and means for preventing said oil from flowing backwards through said mechanical oil pump and said electrical oil pump.

2. An over ride oil pump, as recited in claim 1, wherein said means for activating said electrical oil pump with associated motor comprises an "OR" gate with a multiplicity of inputs, an "AND" gate with two inputs and one or more sensors.

3. An over ride oil pump, as recited in claim 2, further comprising an ignition sensor which senses when a key has been placed into the ignition switch and said switch is rotated to the "ON" position whose output is such that when said ignition is "ON" said ignition sensor transmits a positive signal to one input of said "AND" gate whose output can activate said electrical oil pump thereby allowing operation of said electrical oil pump only when said ignition switch is in "ON" position.

4. An over ride oil pump, as recited in claim 2, further comprising an oil pressure sensor whose output is such that when oil pressure falls below some predetermined level said oil pressure sensors transmits a positive signal to one of the multiplicity of inputs of said "OR" gate thereby producing a positive "OR" gate output which is transmitted to the remaining input of said "AND" gate, thereby activating said electrical oil pump if a positive signal is already present at the other input of said "AND" gate, resulting in supplementary additional oil pressure.

5. An over ride oil pump, as recited in claim 2, further comprising a vacuum sensor whose output is such that when vacuum pressure in an intake manifold or carburetor rises above some predetermined level, indicating a high engine speed said vacuum sensor transmits a positive signal to one of the multiplicity of inputs of said "OR" gate thereby producing a positive "OR" gate output which is transmitted to the remaining input of said "AND" gate, thereby activating said electrical oil pump if a positive signal is already present at the other input of said "AND" gate resulting in supplementary additional oil pressure during periods of exceptionally high engine speed.

6. An over ride oil pump, as recited in claim 2, further comprising a timer which is initiated by the activation of a starting motor and whose output is positive for a selected timing interval and whose output is connected to one of the multiplicity of inputs of said "OR" gates such that when said starting motor is activated said "OR" gate transmits a positive output to the remaining input of said "AND" gate, thereby activating said electrical oil pump if a positive signal is already present at the other input of said "AND" gate, resulting in the operation of said electrical oil pump for a fixed time interval every time ignition is initiated.

7. An over ride oil pump, as recited in claim 1, wherein said means for preventing said oil from flowing backwards through said mechanical oil pump and said electrical oil pump further comprises one-way check valves placed in the outlets of each of said pumps.

* * * * *